US008059845B2

(12) United States Patent
Bryant

(10) Patent No.: US 8,059,845 B2
(45) Date of Patent: Nov. 15, 2011

(54) IN EAR COMMUNICATIONS DEVICE AND STABILIZER

(76) Inventor: Joshua R. Bryant, Bridgeville, PA (US)

( * ) Notice: Subject to any disclaimer, the term of this patent is extended or adjusted under 35 U.S.C. 154(b) by 961 days.

(21) Appl. No.: 12/011,680

(22) Filed: Jan. 29, 2008

(65) Prior Publication Data

US 2008/0181444 A1 Jul. 31, 2008

Related U.S. Application Data

(60) Provisional application No. 60/886,958, filed on Jan. 29, 2007.

(51) Int. Cl.
*H04R 25/00* (2006.01)
*H04R 1/02* (2006.01)
*H04R 9/08* (2006.01)

(52) U.S. Cl. ..... 381/324; 381/91; 381/328; 381/329; 381/361; 381/362; 381/366; 381/367; 381/368; 381/374; 381/375; 381/380; 381/381; 381/385; 181/130; 181/135

(58) Field of Classification Search ..... 381/91, 381/324, 328, 329, 361, 362, 366, 367, 368, 381/374, 375, 380, 381, 385, 322; 181/130, 181/135, 129
See application file for complete search history.

(56) References Cited

U.S. PATENT DOCUMENTS

| | | | | |
|---|---|---|---|---|
| 4,441,576 | A * | 4/1984 | Allen | 181/129 |
| 5,048,090 | A * | 9/1991 | Geers | 381/328 |
| 5,142,587 | A | 8/1992 | Kobayashi | |
| 5,712,453 | A | 1/1998 | Bungardt et al. | |
| 5,953,435 | A | 9/1999 | Mullin et al. | |
| 6,819,762 | B2 | 11/2004 | Jones et al. | |
| 7,068,803 | B2 | 6/2006 | Kuhlmann et al. | |
| 2008/0144877 | A1 * | 6/2008 | Ham et al. | 381/379 |
| 2009/0092269 | A1 * | 4/2009 | Nielsen et al. | 381/313 |
| 2009/0095566 | A1 * | 4/2009 | Leong et al. | 181/135 |
| 2009/0110227 | A1 * | 4/2009 | Prince | 381/380 |
| 2010/0074462 | A1 * | 3/2010 | Lee et al. | 381/381 |

* cited by examiner

*Primary Examiner* — Ngan Ngo
(74) *Attorney, Agent, or Firm* — David G. Oberdick

(57) ABSTRACT

An in-ear stabilizer with a compression strut securely holds an in-ear communications device within the human ear. The in-ear stabilizer comprises an in-ear device housing which fits into the human ear and has a receiver and speaker. Attached to the in-ear device housing is a compression strut which extends, when in the human ear, across the crus of helix and fits securely under the antihelix in the upper concha of the ear. The housing of the in-ear device fits into the lower concha of the human ear. The compression strut exerts outward pressure when compressed, comfortably holding the in-ear device in place through pressure on the lower and upper concha of the human ear.

8 Claims, 2 Drawing Sheets

IN EAR COMMUNICATIONS DEVICE AND STABILIZER

PRIORITY

This application hereby claims priority to provisional patent application Ser. No. 60/886,958 filed on Jan. 29, 2007.

FIELD OF THE INVENTION

The invention generally relates to in-ear communication device, such as a headset, earphone, microphone, and/or ear-plug design, and more particularly relates to the stabilization of an in-ear device within a human ear.

BACKGROUND OF THE INVENTION

A typical concha-style earphone or headset positions an ear piece or receiver in the lower concha (cavum) adjacent to the ear canal and between the tragus and anti-tragus of the ear. The abutment of the receiver against the tragus, anti-tragus, and auditory tract provides modest stability for the earphone. However, different ear sizes and shapes prevent a one-size-fits-all approach, and users often struggle with the instability and uncomforting feeling of these devices because they do not adapt to fit all users. In response to such instability, several devices have been designed to hold a headset or earphone in place. For example, on-the-ear headsets have a plastic or wire loop that fits around the ear allowing the headset to hang in place. In-the-ear designs generally fit within the lower concha, and have various stabilization techniques. These current designs continue to have stability, user-adaptation and comfort issues, however.

Accordingly, it is an object of the present invention to provide an in-ear stabilizer with a compression strut that securely holds an in-ear device within the human ear and that is adaptable to different ear sizes.

SUMMARY OF THE INVENTION

An object of the present invention is to provide an in-ear communication device with a compression strut that securely holds the device within the human ear.

Another object of the present invention is to attach a compression strut to an in-ear device such that the housing of the in-ear device fits into the lower concha of the human ear and the compression strut, when extended across the crus of the helix of the human ear, fits securely under the antihelix in the upper concha of the ear. The compression strut exerts outward pressure against the antihelix of the ear, when under compression, thereby comfortably holding the in-ear device in place through pressure on the lower and upper concha of the human ear.

DETAILED DESCRIPTION OF THE INVENTION

The present invention will now be described in detail in relation to a preferred embodiment and implementation thereof, which is exemplary in nature and descriptively specific as disclosed. As is customary, it will be understood that no limitation of the scope of the invention is thereby intended. The invention encompasses such alterations and further modifications in the illustrated apparatus and method, and such further applications of the principles of the invention illustrated herein, as would normally occur to persons skilled in the art to which the invention relates.

Figure 1:
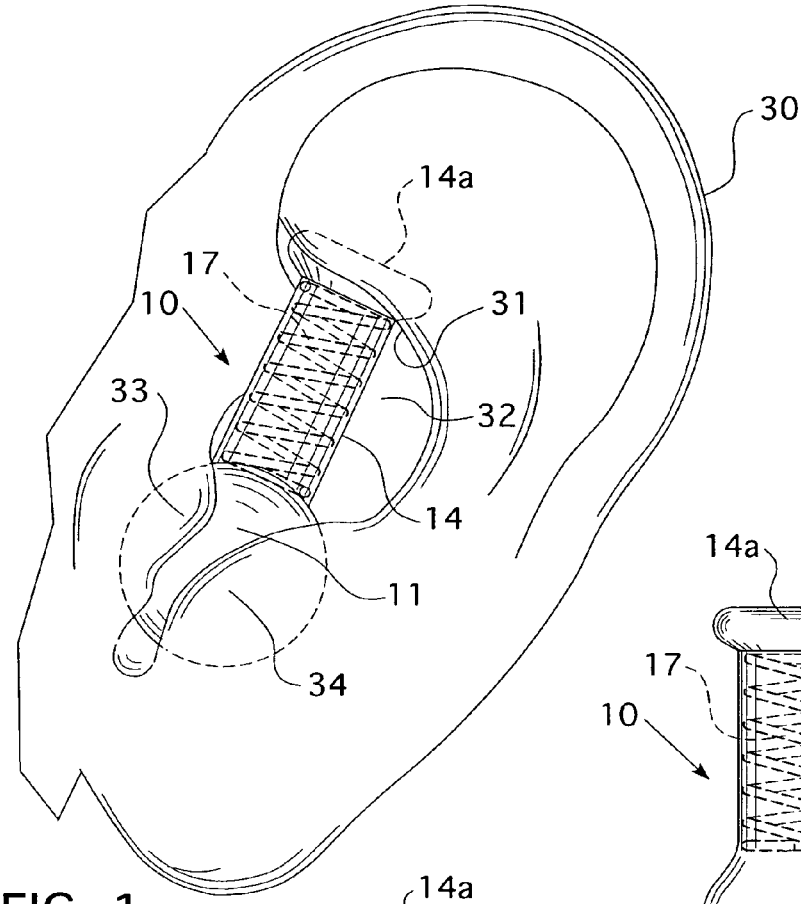
FIG. 1 shows the in-ear communications device and stabilizer of the present invention in place in the human ear.
Figure 2:
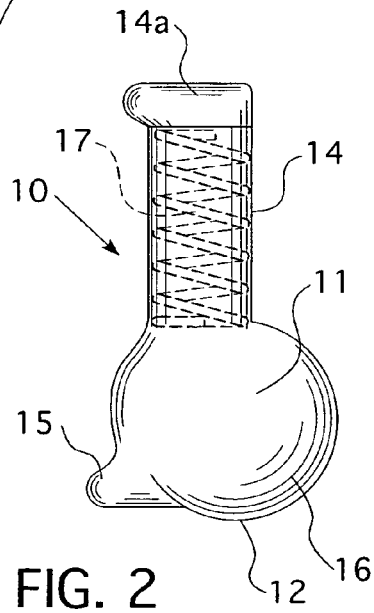
FIG. 2 shows a side view of the in-ear communications device and stabilizer of the present inventions.

As shown generally in FIGS. 1 and 2, the present invention (10) includes an in-ear device (11), and a compression strut (14). FIG. 1 demonstrates the position of the compression strut (14) within the concha (32) of a human ear (30). The top (14*a*) of the compression strut (14) is fitted underneath the antihelix (31) of the ear (30). The compression strut (14) exerts outward and/or upward pressure against the underside of the antihelix (31), and therefore, securely holds the in-ear communications device and stabilizer (10) between the antihelix (31) and the lower concha (32) of the ear (30) adjacent to the ear canal. The in-ear device (11), is located in the lower part of the concha (32), is secured between the tragus (33) and anti-tragus (34) of the human ear (30).

Figure 3:
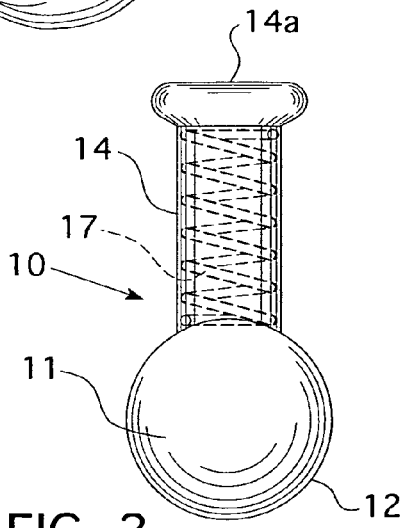
FIG. 3 shows a front view of the in-ear communications device and stabilizer of the present invention.

As shown in FIGS. 1, 2 and 3, the in-ear device (11) has a housing (12) that encases the in-ear device (11) and that holds a speaker (15) and a receiver (16). In one embodiment, the speaker can be located inwardly toward the ear, although other configurations are also possible, including configurations where a portion of housing (12) is located outside of the ear and can include a receiver (16). The in-ear device (11) is attached to the compression strut (14). The in-ear device housing (12) covers the in-ear device (11) for comfort. The compression strut (14) is responsible for stabilizing in-ear device (11) within the human ear (30). In one embodiment of the present invention, compression strut (14) has an enclosed helical volute spring (17) that has a range of compression and a mechanical means of providing pressure against strut top (14*a*) to secure the strut top (14*a*) against the inside of the antihelix (31) of ear (30). The range of compression allows the present invention to adjust to different ear sizes. The spring (17) or other similar mechanical means of allowing for compression and pressure provides a rigidity and stability that is lacking in compression means comprised entire of foam, rubber or some other compressible material. More specifically, the present invention differs from previous in-ear device stabilization techniques by providing a mechanical compression strut that fits into the concha of a human ear above the in-ear device housing (12). The compression strut (14) of the present invention fits entirely within the concha cavity (32) and provides a dynamic, comfortable, and non-obtrusive fit for any ear, no matter what size. Single hand insertion is possible by inserting the top of the compression strut (14) into the concha (32) under the anti-helix (31), compressing the compression strut (14), and then inserting the in-ear device (11) into the concha (32), and finally releasing the in-ear device (11) into the lower concha (32).

Figure 4:
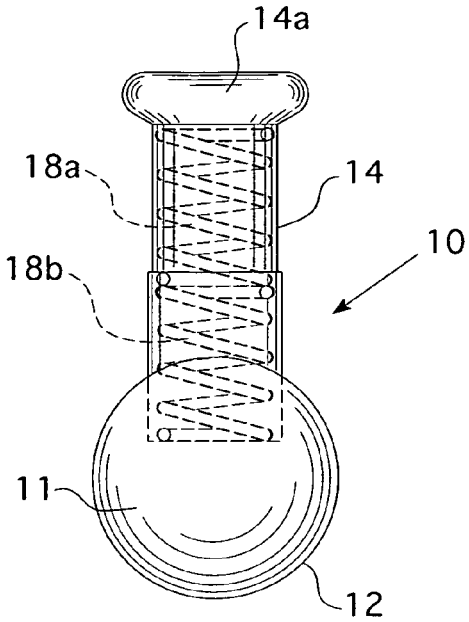
FIG. 4 shows one preferred embodiment of the in-ear communications device and stabilizer of the present invention and, more specifically, the compression strut that provides stabilization.

FIG. 4 illustrates another preferred embodiment for the compression strut (14) with two springs (18*a* and 18*b*), the first spring (18*a*) fitting or telescoping inside the second (18*b*). Once again, these springs compress and provide pressure to stabilize and hold the in-ear device (11) in place within the human ear (30).

Figure 5:
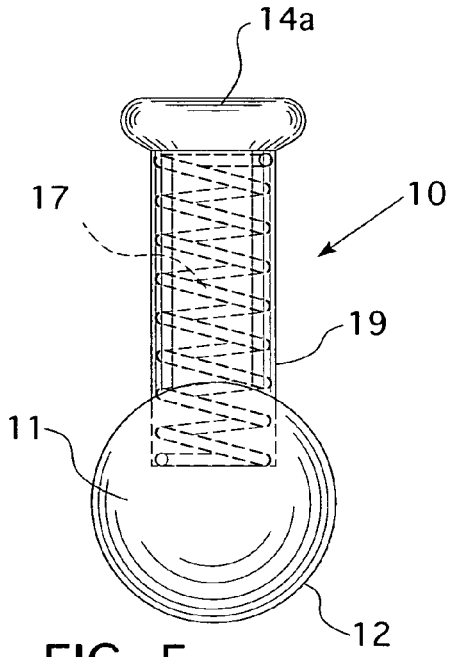
FIG. 5 shows the housing encasing the compression strut in one embodiment of the present invention.

FIG. 5 demonstrates another embodiment for the compression strut of the present invention where a spring (17) is surrounded by a casing (19). Casing (19) is made of rubber, silicone, plastic or any other semi-flexible or compressible material so that it is also compressible. Casing (19) helps guide the compression path of spring (17).

Figure 6:
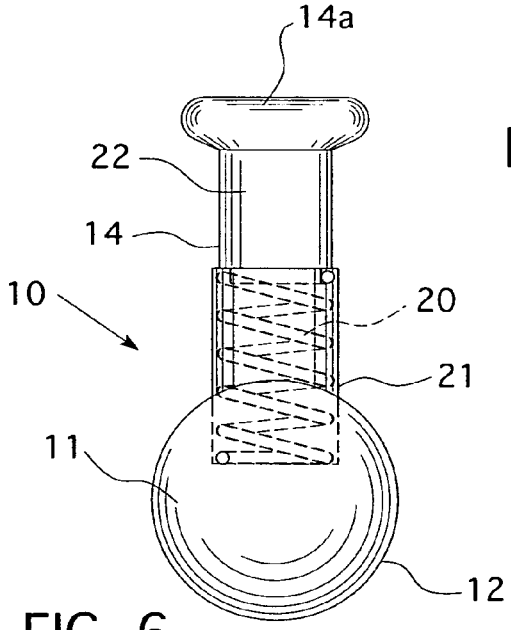
FIG. 6 shows another preferred embodiment of the in-ear device and stabilizer of the present invention, where a mount is on the end of the compression strut.

FIG. 6 depicts a further embodiment of the compression strut (14) of the present invention, where strut (14) comprised of a spring (20) in casing (21) and an upper rod (22) which contacts spring (20) and telescopes within casing (21) when strut (14) is compressed. More specifically, when rod (22) is pushed downward upon contact with an ear, such action causes spring (20) to compress and provide pressure upward through strut (14) and against the anti-helix (31). Rod (22) may have a top mount (14*a*) that is operable to securely hold the strut under the anti-helix (31) of a human ear (30). This same mount (14*a*) can also be used with other embodiments (see FIGS. 1-5). A rubber, silicone or flexible and compressible material can optionally be mounted on the top rod (22) to further aid in the compression of strut (14). In this embodiment, casing (21) and rod (22) can be rigid and is comprised of plastic, metal or like rigid material. Alternatively, casing (21) and rod (22) can be comprised of a compressible material.

In all embodiments, the mechanical spring mechanism is preferably comprised of a rigid material such as plastic or metal and the spring and its cross-section may have varying shapes, such as helical, volute, cylindrical or conical. The in-ear device housing (12) and internal communications devices, i.e., speakers and receivers and related electronics, can be comprised of any of such elements currently known to those skilled in the art, and the housing (12) can have varying shapes and composition materials. Preferably, housing (12) is comprised of a semi-flexible material to allow for user comfort, but can also be comprised of other materials.

What is claimed is:

1. An in-ear communications device and stabilizer comprised of:

an in-ear communications device housing that sits inside the lower concha and between the tragus and anti-tragus of the human ear; and a compression strut connected to said device housing which compresses to fit said device within the concha of a human ear and stabilizes said device by providing pressure between said device and the anti-helix of the human ear.

2. The in-ear communications device and stabilizer of claim 1, where said compression strut is comprised of a mechanical spring.

3. The in-ear communications device and stabilizer of claim 2, where said compression strut is further comprised of a compressible casing located around said spring.

4. The in-ear communications device and stabilizer of claim 1, where said compression strut is comprised of a mechanical spring positioned within an external casing.

5. The in-ear communications device and stabilizer of claim 1, where said compression strut is comprised of first and second springs; said first spring operable to telescope within second spring upon compression.

6. The in-ear communications device and stabilizer of claim 5, where said compression strut is further comprised of a flexible casing located around said first and second springs.

7. The in-ear communications device and stabilizer of claim 1, where said compression strut is comprised of a lower spring within a casing and an upper rod that contacts the top of said spring and telescopes within said casing upon compression of said strut.

8. The in-ear communications device and stabilizer of claims 1, 2, 3, 4, 5, 6 or 7, where said compression strut is further comprised of a mount located at the top of said strut, said mount operable to secure said strut under the anti-helix of the human ear.

* * * * *